US010197305B2

(12) United States Patent
de Waele et al.

(10) Patent No.: US 10,197,305 B2
(45) Date of Patent: Feb. 5, 2019

(54) CRYOCOOLER AND CRYOCOOLER OPERATION METHOD

(71) Applicant: SUMITOMO HEAVY INDUSTRIES, LTD., Tokyo (JP)

(72) Inventors: A. T. A. M de Waele, Veldhoven (NL); Mingyao Xu, Nishitokyo (JP); Qian Bao, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 326 days.

(21) Appl. No.: 14/977,208

(22) Filed: Dec. 21, 2015

(65) Prior Publication Data

US 2016/0178247 A1 Jun. 23, 2016

(30) Foreign Application Priority Data

Dec. 22, 2014 (JP) ..... 2014-259040
Jul. 23, 2015 (JP) ..... 2015-146032

(51) Int. Cl.
*F25B 9/06* (2006.01)
*F25B 9/14* (2006.01)
*F25B 9/12* (2006.01)

(52) U.S. Cl.
CPC ..... *F25B 9/14* (2013.01); *F25B 9/06* (2013.01); *F25B 9/12* (2013.01)

(58) Field of Classification Search
CPC ..... F25B 9/14; F25B 9/06
USPC ..... 62/6
See application file for complete search history.

(56) References Cited

U.S. PATENT DOCUMENTS

| | | | |
|---|---|---|---|
| 3,992,893 | A | 11/1976 | Claudet et al. |
| 5,347,819 | A | 9/1994 | Saji et al. |
| 5,697,219 | A | 12/1997 | Nagao |
| 2008/0104967 | A1 | 5/2008 | Satoh |
| 2014/0202174 | A1 | 7/2014 | Wang |

FOREIGN PATENT DOCUMENTS

| | | | |
|---|---|---|---|
| JP | 2003-021414 | A | 1/2003 |
| JP | 2005-283026 | A | 10/2005 |
| JP | 2006-242484 | A | 9/2006 |

*Primary Examiner* — John F Pettitt
(74) *Attorney, Agent, or Firm* — HEA Law PLLC

(57) ABSTRACT

In a cryocooler for developing coldness of 4 K or lower by expanding helium, an expander expands high-pressure helium. A compressor compresses low-pressure helium returned from the expander, to generate high-pressure helium, and supplies the high-pressure helium to the expander. When helium temperature in the expander is 2.17 K or lower, the pressure of the low-pressure helium is equal to or higher than pressure given by a curve, in a helium state diagram in which the horizontal axis is temperature and the vertical axis is pressure, along which helium's volumetric thermal expansion coefficient is 0.

10 Claims, 4 Drawing Sheets

CRYOCOOLER AND CRYOCOOLER OPERATION METHOD

RELATED APPLICATIONS

Priority is claimed to Japanese Patent Application Nos. 2014-259040 and 2015-146032, filed Dec. 22, 2014 and Jul. 23, 2015, the entire content of each of which is incorporated herein by reference.

BACKGROUND

Technical Field

Certain embodiments of the present invention relate to cryocoolers and cryocooler operation methods that give rise to coldness by expanding high-pressure helium supplied from a compression device.

Description of Related Art

Examples of prior-disclosed cryocoolers include displacer-type cryocoolers furnished with an expander configured to movably accommodate a displacer in the interior of a cylinder. With displacer-type cryocoolers, while the displacer in the cylinder interior is reciprocated, helium inside the expander is made to expand, giving rise to coldness. The helium chilling that occurs in the expander builds up in a regenerator and meanwhile is transmitted to a cooling stage, which, reaching a desired cryogenic temperature, refrigerates a refrigeration article connected to the cooling stage.

When a cryocooler is used to generate liquid helium under, for example, atmospheric pressure, it develops coldness at a usual 4 K level. If the temperature that the chill reaches could be lowered further, helium superfluid transition temperatures, for example, could then be made available.

SUMMARY

The present invention in one embodiment is a cryocooler for developing coldness of 4 K or lower by expanding helium, the cryocooler including: an expander for expanding high-pressure helium; and a compressor for compressing low-pressure helium, returned from the expander, to generate high-pressure helium, and supplying the high-pressure helium to the expander. When helium temperature in the expander is 2.17 K or lower, the pressure of the low-pressure helium is equal to or higher than pressure given by a curve, in a helium state diagram whose horizontal axis is temperature and whose vertical axis is pressure, along which helium's volumetric thermal expansion coefficient is 0.

The present invention in another embodiment is a method of operating a cryocooler developing coldness of 4 K or lower by expanding helium in the cryocooler. The cryocooler includes an expander for expanding high-pressure helium, and a compressor for compressing low-pressure helium returned from the expander, to generate high-pressure helium, and supplying the high-pressure helium to the expander. The method includes a step of detecting temperature of helium in the expander; and a step of, when the detected temperature is 2.17 K or lower, setting pressure of the low-pressure helium to pressure given by a curve, in a helium state diagram whose horizontal axis is temperature and vertical axis is pressure, along which helium's volumetric thermal expansion coefficient is 0.

DETAILED DESCRIPTION

It is desirable to provide a technology which decreases a reached temperature of coldness generated by a cryocooler.

According to certain embodiments of the present invention, it is possible to provide a technology which decreases a reached temperature of coldness generated by a cryocooler.

An embodiment of the present invention will be described with reference to the drawings.

Figure 1:
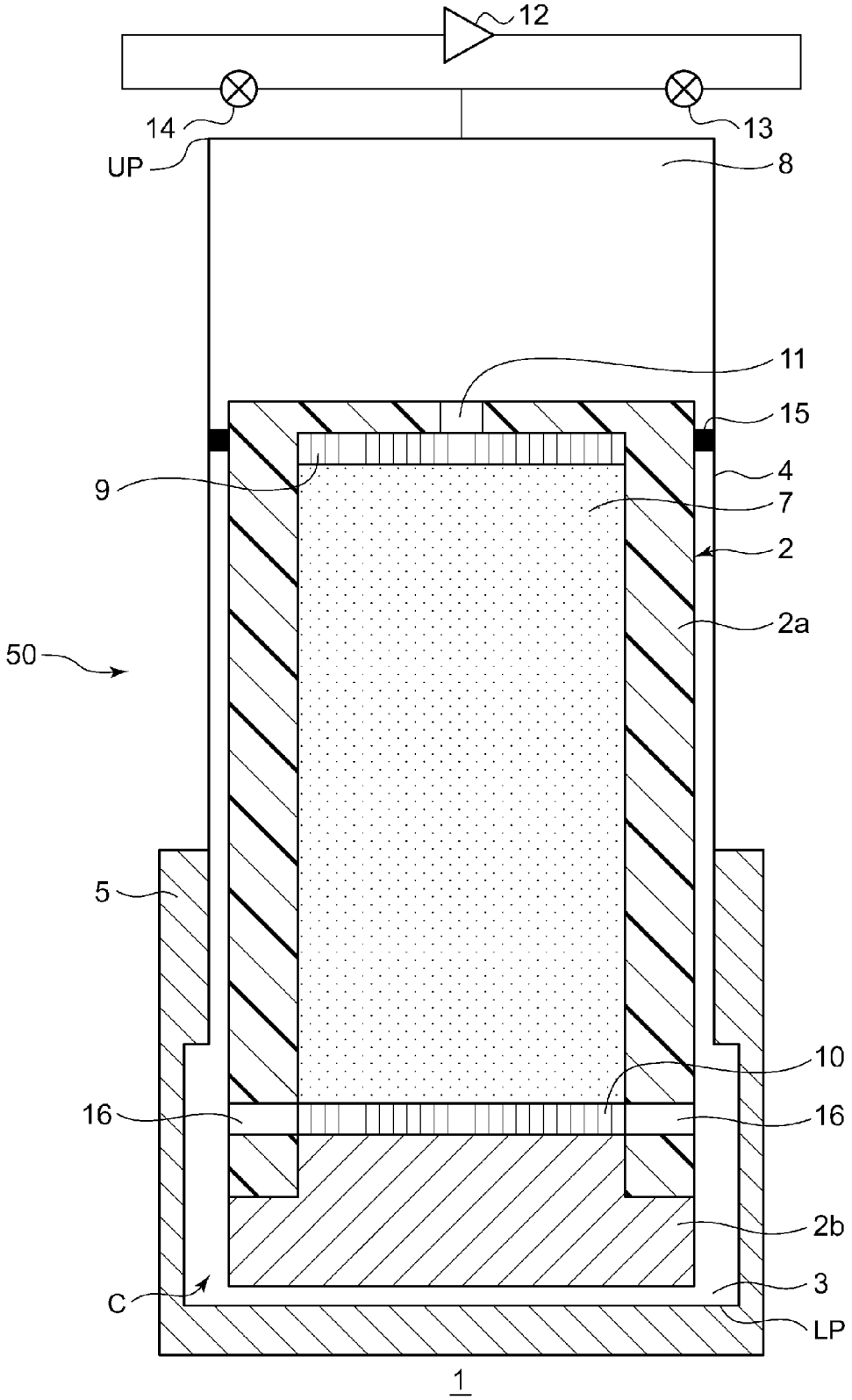
FIG. 1 is a schematic diagram showing a cryocooler according to an embodiment of the present invention.

FIG. 1 is a schematic diagram showing a cryocooler 1 according to an embodiment of the present invention. The cryocooler 1 according to the embodiment is a Gifford McMahon type freezer which uses helium of helium-4 ($^4$He) as a refrigerant gas. The cryocooler 1 includes a cylinder 4 which forms an expansion space 3 expanding high-pressure helium between a displacer 2 and the cylinder 4, and a tubular bottomed cooling stage 5 which is adjacent to the expansion space 3 and is positioned so as to enclose the expansion 3. The cooling stage 5 functions as a heat exchanger which performs heat exchange between a cooling object and the helium. Hereinafter, in the present specification, the entire configuration which accommodates the displacer 2 in the cylinder 4 and expands the helium is referred to as an "expander 50". After a compressor 12 recovers low-pressure helium returned from the expander 50 and compresses the low-pressure helium, the compressor 12 supplies high-pressure helium to the expander 50.

The displacer 2 includes a main body portion 2*a* and a lid portion 2*b* included in a low-temperature end. The lid portion 2*b* may be configured of the same member as the main body portion 2*a*. In addition, the lid portion 2*b* may be configured of a material having higher thermal conductivity than the main body portion 2*a*. Accordingly, the lid portion 2*b* functions as a thermal conducting portion which performs heat exchange between the lid portion 2*b* and helium which flows in the lid portion 2*b*. For example, a material having higher thermal conductivity than at least the main body portion 2*a* such as copper, aluminum, or stainless steel is used for the lid portion 2*b*. For example, the cooling stage 5 is configured of copper, aluminum, stainless steel, or the like.

The cylinder 4 accommodates the displacer 2 so that the displacer can reciprocate in a longitudinal direction. From the viewpoints of strength, thermal conductivity, helium blocking performance, or the like, for example, stainless steel is used for the cylinder 4.

A scotch yoke mechanism (not shown) which reciprocates the displacer 2 is provided on a high-temperature end of the displacer 2, and the displacer 2 reciprocates in an axial direction of the cylinder 4.

The displacer 2 includes a tubular outer circumferential surface, and the inner portion of the displacer 2 is filled with a regenerator material. The internal space of the displacer 2 configures a regenerator 7. An upper end flow smoother 9 and a lower end flow smoother 10 which make the flow of the helium smooth are respectively provided on the upper end side and the lower end side of the regenerator 7.

An upper opening 11, through which the helium flows from a room temperature chamber 8 to the displacer 2, is formed on the high-temperature end of the displacer 2. The room temperature chamber 8 is a space which is formed of the cylinder 4 and the high-temperature end of the displacer 2, and the volume of the room temperature chamber 8 is changed according to the reciprocation of the displacer 2.

Among lines which connect supply-return systems including the compressor 12, a supply valve 13, and a return valve 14, to each other, a common supply-return line is connected to the room temperature chamber 8. In addition, a seal 15 is mounted between the high-temperature end portion of the displacer 2 and the cylinder 4.

A port 16 which introduces the helium into the expansion space 3 is formed on the low-temperature end of the displacer 2. In addition, a clearance C serving as a flow passage of helium which connects the internal space of the displacer 2 and the expansion space 3 is provided between the outer wall of the displacer 2 and the inner wall of the cylinder 4.

The expansion space 3 is a space which is formed by the cylinder 4 and the displacer 2, and the volume of the expansion space 3 is changed according to the reciprocation of the displacer 2. The cooling stage 5 which is thermally connected to a cooling object is disposed at positions of the outer circumference and the bottom portion of the cylinder 4 corresponding to the expansion space 3. The helium flows into the expansion space 3 through the port 16 and the clearance C. Accordingly, the helium is supplied to the expansion space 3.

Next, an operation of the cryocooler 1 will be described.

At a certain point of time during a helium supply process, as shown in FIG. 1, the displacer 2 is positioned at a bottom dead center LP of the cylinder 4. Simultaneously with or at a timing deviated from the certain point of time, the supply valve 13 is opened, and high-pressure helium is supplied into the cylinder 4 from the common supply-return line via the supply valve 13. As a result, the high-pressure helium flows into the regenerator 7 inside the displacer 2 from the upper opening 11 positioned on the upper portion of the displacer 2. The high-pressure helium flowing into the regenerator 7 is supplied to the expansion space 3 via the port 16 of the helium and the clearance C positioned on the lower portion of the displacer 2 while being cooled by the regenerator material.

When the expansion space 3 is filled with the high-pressure helium, the supply valve 13 is closed. In this case, the displacer 2 is positioned at a top dead center UP inside the cylinder 4. Simultaneously with or at a timing deviated from when the displacer 2 is positioned at the top dead center UP inside the cylinder 4, the return valve 14 is opened, and the helium of the expansion space 3 is decompressed and expanded. The helium, in which the temperature has decreased due to the expansion, in the expansion space 3 absorbs heat of the cooling stage 5.

The displacer 2 moves toward the bottom dead center LP, and the volume of the expansion space 3 decreases. The helium inside the expansion space 3 returns to the displacer 2 through the port 16 and the clearance C. In this case, the helium absorbs the heat of the cooling stage 5. The helium which flows from the expansion space 3 into the regenerator 7 cools the regenerator material inside the regenerator 7. The helium flows into the displacer 2 is returned to the intake side of the compressor 12 via the regenerator 7 and the upper opening 11. The above-described processes are set to one cycle, the cryocooler 1 repeats this cooling cycle, and the cooling stage 5 is cooled.

As described above, in the cryocooler 1 according to the embodiment, by reciprocating the displacer 2 in the cylinder 4 which configures the expander 50, the helium inside the expansion space 3 is expanded and coldness is generated.

Here, a coldness having approximately 4.2 K, which is a boiling point of helium under atmospheric pressure, is generated. Accordingly, preferably, in the compressor 12, an operation pressure of the high-pressure side is set to 25 bar, and the operation pressure on the low-pressure side is set to 8 bar. That is, by repeating the cooling cycle in which the helium inside the expander 50 is expanded so that the pressure goes from 25 bar to 8 bar, in the cryocooler 1, it is possible to effectively generate the coldness having approximately 4 K at which the helium is liquefied under atmospheric pressure.

Sequentially, physical properties of the helium-4 having a cryogenic temperature of 4 K or lower will be described. In helium, helium-4 ($^4$He) and helium-3 ($^3$He) exist as isotopes. However, the physical properties of both at a cryogenic temperature are different from each other. Hereinafter, it will be described on the assumption that the helium is helium-4.

Figure 2:
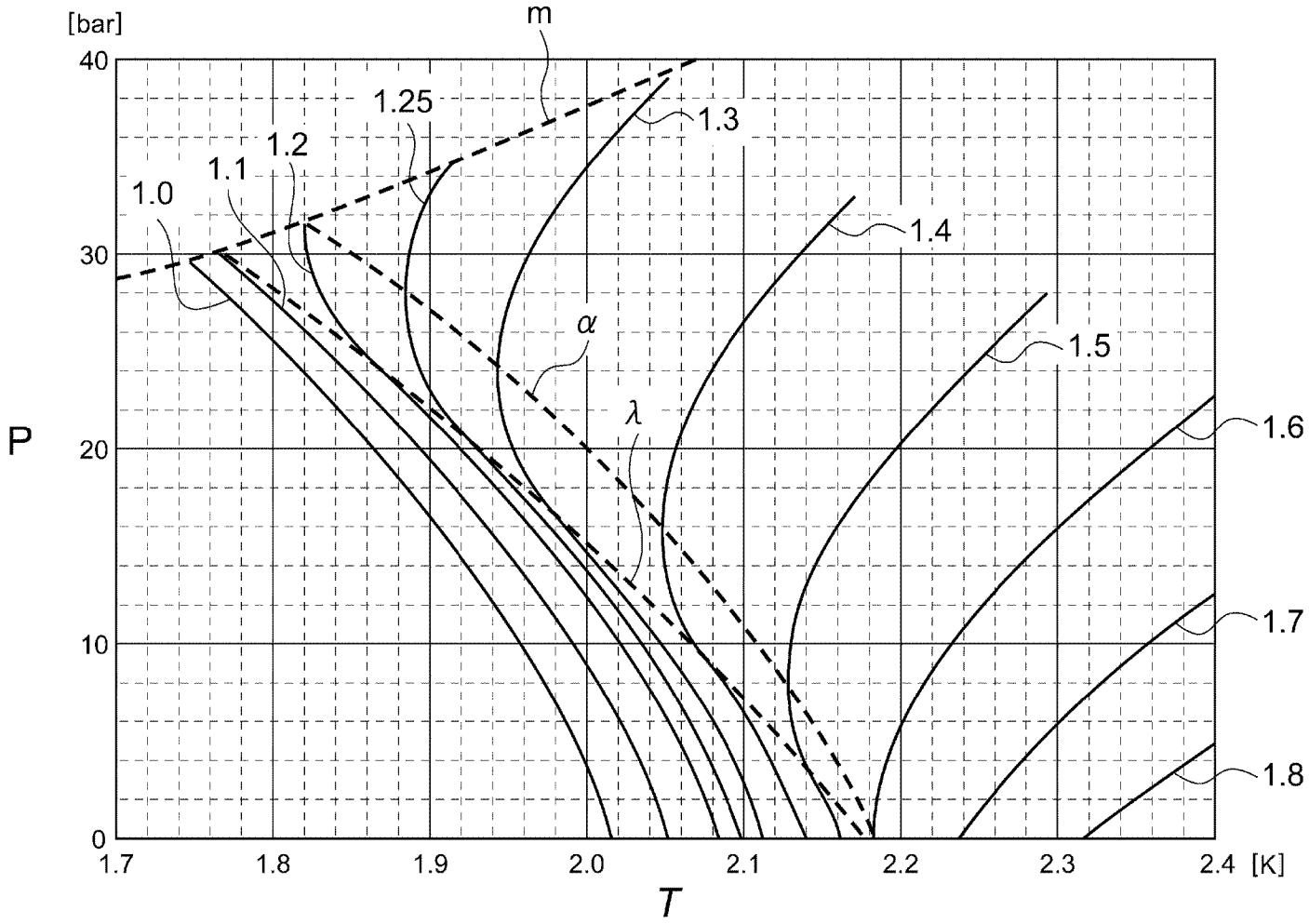
FIG. 2 is a state diagram showing a phase of helium-4 at a cryogenic temperature.

FIG. 2 is a state diagram showing a phase of helium-4 at a cryogenic temperature. FIG. 2 is a diagram which is generated using HePak (version 3.40) of Horizon Technologies Co. Ltd, United States.

FIG. 2 is the state diagram of helium in which a horizontal axis indicates a temperature T K and a vertical axis indicates a pressure P bar. In FIG. 2, a temperature range of the helium is from 1.7 K to 2.4 K, and a pressure range of the helium is from 0 bar to 40 bar. In FIG. 2, a broken line indicated by m is a liquefaction curve of helium. In addition, a broken line indicated by λ is a lambda line (λ line). When the temperature and the pressure of helium are below the λ line, the helium is in a superfluidity state.

In FIG. 2, a broken line indicated by α shows a curve in which a volumetric thermal expansion coefficient α of helium becomes 0. Hereinafter, in the present specification, in the state diagram shown in FIG. 2, for convenience, the curve in which the volumetric thermal expansion coefficient of helium becomes 0 is referred to as an "α curve".

In FIG. 2, in a region above the α curve, the volumetric thermal expansion coefficient α of helium is a positive value. In addition, in a region below the α curve, the volumetric thermal expansion coefficient α of helium is a negative value. When the temperature and the pressure of the helium are above the α curve, if the helium is adiabatically expanded, the temperature of the helium decreases. Meanwhile, when the temperature and the pressure of the helium are below the α curve, if the helium is adiabatically expanded, the temperature of the helium increases.

In FIG. 2, solid lines shown along with numbers indicate isentropic curves of helium. Each number indicates entropy s J/gK per unit mass of helium. For example, the entropy s per unit mass of the helium in which the pressure is 24 bar and the temperature is 2.09 K is 1.407 J/gK. When the helium is adiabatically expanded, the temperature and the pressure of the helium are changed along the isentropic curve.

The boiling point of helium is approximately 4.2 K at 1 atm (approximately 1 bar). When the temperature of the helium of 1 bar is 4.2 K or lower, the helium is brought into liquid helium. If the helium of 1 bar and 4.2 K is decompressed and steam pressure decreases to approximately 0.05 bar, the temperature of the helium is approximately 2.17 K. In this case, the helium is transferred into a superfluidity state. That is, a superfluidity transfer temperature of helium is approximately 2.17 K at a saturated steam pressure.

As shown in FIG. 2, the λ line of helium is a curve which descends toward the right and has a negative inclination in the state diagram. This means that the superfluidity transfer temperature of the helium decreases if the pressure of the helium increases. Accordingly, in order to transfer the helium to the superfliudity state, a coldness having at least 2.17 K is required. Hereinafter, in the present specification, except as particularly distinguished, a "superfluidity temperature range" means a temperature region which is lower than or equal to 2.17 K which is a minimum required temperature so as to transfer the helium to the superfluidity state.

As is obvious from FIG. 2, when the helium is adiabatically expanded within the superfluidity temperature range, the temperature of the helium does not decrease below a temperature at an intersection point between the isentropic curve and the α curve. That is, in the state diagram of helium shown in FIG. 2, the temperature at the intersection point between the isentropic curve and the α curve indicates a lower limit value of the reached temperature of the helium when the helium is adiabatically expanded.

As is obvious from FIG. 2, the α curve is above the λ curve, and the λ curve and the α curve do not intersect each other. This means that if the helium is decompressed within the superfluidity temperature range and is adiabatically expanded, the helium reaches the lowest temperature before the helium is λ-transferred and is brought into the superfluidity state. That is, if the helium is decompressed up to immediately before the helium is λ-transferred, the temperature of the helium increases after the temperature of the helium reaches the lowest temperature. Accordingly, when the helium is adiabatically expanded in the superfluidity temperature range, decompression is controlled so that the pressure of the helium in the expansion space 3 is not lower than the pressure of the intersection point between the isentropic curve and the α curve. Accordingly, it is possible to prevent the temperature of the helium from increasing due to the adiabatic expansion, and it is possible to increase cooling efficiency.

In addition, similarly to the λ curve, the α curve is a curve which descends toward the right and has a negative inclination in the state diagram of helium shown in FIG. 2. This means that the pressure at the intersection point between the isentropic curve and the α curve increases if the entropy of helium decreases. If adiabatic expansion is performed in the expansion space 3, the temperature of the helium decreases, and the entropy per unit mass of helium decreases. Therefore, the entropy of helium decreases according to the cooling cycle being repeatedly performed on the helium within the superfluidity temperature range, and the pressure at the intersection point between the isentropic curve and the α curve increases.

Accordingly, based on the lowest reached temperature which is a target temperature, the cryocooler 1 calculates the entropy of the helium at the temperature. When the temperature of the helium inside the expansion space 3 is detected and the detected temperature is at least 2.17 K or lower, the pressure on the low-pressure side in the operation pressure of the compressor 12 is set so as to be equal to or higher than the pressure at the intersection point between the isentropic curve and the α curve in the calculated entropy. Accordingly, the pressure of the low-pressure helium inside the expansion space 3 changes the upper side of the α curve of the helium in the state diagram shown in FIG. 2. Since the pressure of the helium is equal to or higher than the pressure at the intersection point between the isentropic curve and the α curve, it is possible to prevent the temperature of the helium from increasing due to the adiabatic expansion of the helium. As a result, it is possible to increase cooling efficiency in the superfluidity temperature range of the cryocooler 1. In addition, when it is difficult to directly detect the temperature of the helium inside the expansion space 3, the temperature of the cooling stage 5 is measured, and the measured temperature may be regarded as the temperature of the helium inside the expansion space 3.

Alternatively, when the temperature of the helium inside the expansion space 3 is 2.17 K or lower, the set value of the pressure on the low-pressure side of the operation pressure of the compressor 12 may be adaptively changed according to the temperature of the helium. More specifically, in the state diagram shown in FIG. 2, the pressure at the intersection point between the isentropic curve and the α curve according to the entropy which is determined according to the temperature of helium may be set to the set value of the pressure on the low-pressure side of the operation pressure of the compressor 12. Accordingly, when the temperature of the helium inside the expansion space 3 is high, the set value of the pressure on the low-pressure side of the operation pressure of the compressor 12 decreases, and it is possible to generate a coldness having a lower temperature in the expansion space 3.

For example, the pressure on the low-temperature side of the compressor 12 may be 15 bar. In this case, the pressure of the helium inside expansion space 3 is equal to or higher than at least 15 bar. In the α curve shown in FIG. 2, when the pressure is 15 bar, the temperature is approximately 2.06 K. That is, by setting the pressure on the low-temperature side of the compressor 12 to 15 bar, the lowest reached temperature of the coldness generated by the cryocooler 1 reaches 2.06 K. This temperature is lower by 0.1 K or higher than 2.17 K which is the lowest temperature required for transferring helium to the superfluidity state. Accordingly, the cryocooler 1 can be stably used as a cryocooler for transferring helium to the superfluidity state.

In many cases, the cryocooler 1 is used for liquefying helium. As described above, if the high-pressure side of the operation pressure of the compressor 12 is set to 25 bar, it is possible to effectively generate a coldness having approximately 4.2 K which is a boiling point of helium under atmospheric pressure. Accordingly, in many cases, since the pressure of the high-pressure side of the operation pressure of the existing compressor is set to approximately 25 bar, the entire cryocooler 1 is likely to be designed so as to have pressure resistance of approximately 25 bar.

In general, in the cryocooler 1, when a difference between the pressure on the low-pressure side and the pressure on the high-pressure side of the compressor 12 decreases, operation efficiency of the cryocooler 1 decreases. When the existing cryocooler 1, in which the high-pressure side of the operation pressure of the compressor 12 is approximately 25 bar, is used, even when the pressure on the low-pressure side of the compressor 12 is 15 bar, the differential pressure is 10 bar. Accordingly, it is considered that the operation efficiency of the cryocooler 1 is within a practical range. Therefore, by setting the pressure of the low-pressure side of the compressor 12 to 15 bar, it is possible to generate coldness sufficient to transfer helium to the superfluidity state even when the pressure resistance design of the cryocooler 1 is not changed.

For example, the pressure of the low-pressure side of the compressor 12 may be 25 bar. In this case, the pressure of the helium inside the expansion space 3 is equal to or higher than at least 25 bar. In the α curve shown in FIG. 2, when the pressure is 25 bar, the temperature is approximately 1.93 K. In this case, the cryocooler 1 can generate a coldness lower than 2 K, and it is possible to more stably supply the superfluidity transfer temperature of helium.

When the pressure of the low-pressure side of the compressor 12 is set to 25 bar, the pressure on the high-pressure side is set so as to be 25 bar or higher. In order to increase the operation efficiency of the cryocooler 1, preferably, the pressure on the high-pressure side of the compressor 12 is sufficiently higher than the pressure on the low-pressure side. However, if the pressure on the high-pressure side of the compressor 12 is too high, the pressure of helium also increases, and the helium becomes solid regardless of the temperature.

As described above, in the state diagram shown in FIG. 2, the broken line indicated by m is the liquefaction curve of helium. In the state diagram shown in FIG. 2, when the temperature and the pressure of the helium are above the liquefaction curve, the helium becomes solid. Accordingly, in order to operate the cryocooler 1, the pressure on the high-pressure side of the compressor 12 is set so that the pressure of helium is below the liquefaction curve of the helium in the state diagram.

For example, the pressure on the high-pressure side of the compressor 12 is 35 bar. In this case, the pressure of the helium inside the expansion space 3 is less than or equal to at most 35 bar. In the liquefaction curve of helium shown in FIG. 2, when the pressure is 35 bar, the temperature is approximately 1.91 K. The entropy s per unit mass of helium in which the pressure is 35 bar and the temperature is 1.91 K is approximately 1.25 J/gK. In the state diagram shown in FIG. 2, the isentropic curve in which the entropy s per unit mass is 1.25 J/gK intersects the α curve approximately at points of 1.82 K and 28 bar. Accordingly, by setting the pressure on the low-pressure side of the compressor 12 to 28 bar, the cryocooler 1 can generate a coldness having 1.9 K or lower. In addition, it is also possible to prevent the helium from becoming solid.

Next, in the state diagram of helium shown in FIG. 2, expressions indicating the α curve will be described.

When helium is adiabatically expanded, that is, when the helium is decompressed while the entropy of the helium is constantly maintained, the temperature of the helium is changed depending on the pressure. As shown in FIG. 2, the temperature of the helium is a minimum value with respect to the pressure within the superfluidity temperature range. This means that a pressure Po satisfying $\partial T/\partial P=0$ exists within the superfluidity temperature range when the temperature of the helium is defined as T K, the pressure is defined as P bar, and the entropy per unit mass is defined as s J/gK. In addition, in this case, the temperature of the helium is defined as To.

The pressure Po satisfying $\partial T/\partial P=0$ within the superfluidity temperature range is changed according to the entropy s per unit mass of the helium. Accordingly, the pressure Po can be expressed by Po(s) as a function of the entropy s per unit mass of the helium. Similarly, the temperature To of the helium when $\partial T/\partial P=0$ is satisfied is expressed by To(s) as a function of the entropy s per unit mass of the helium. As described above, the α curve can be expressed by a point (To(s), Po(s)) with the entropy s per unit mass of the helium as the parameter, in the state diagram of the helium shown in FIG. 2. That is, when the entropy s per unit mass of the helium is changed, the α curve is expressed according to a trajectory drawn by the point (To(s), Po(s)).

The α curve is expressed by the following expression using partial differentiation.

$$\left(\frac{\partial T}{\partial P}\right)_S = 0 \qquad \text{Expression 1}$$

As shown in FIG. 2, the entropy s per unit mass of the helium is changed between 1.2 J/gK and 1.6 J/gK.

In the state diagram of helium shown in FIG. 2, the expression indicates a trajectory in which a point having a temperature gradient of 0 with respect to the pressure change of the helium gas within the superfluidity temperature range is drawn when the entropy s per unit mass of the helium gas is changed. The α curve is a curve which provides the lowest temperature which the helium gas can reach when the helium gas is adiabatically expanded within the superfluidity temperature range.

As described above, the cryocooler 1 according to the embodiment can decrease the reached temperature of the coldness generated by the expansion of the helium.

Particularly, according to the cryocooler 1 of the embodiment, it is possible to stably generate the coldness which is lower than or equal to 2.17 K which is the superfluidity transfer temperature of helium-4. Accordingly, the cryocooler according the embodiment can be used for a cryocooler for performing superfluidity transfer on helium-4. There is a cryocooler which generates the coldness within the temperature region using helium-3. However, compared to the helium-3, the cost of the helium-4 is significantly low. Accordingly, the cryocooler 1 according to the embodiment can provide the superfluidity transfer temperature of the helium-4 at a low cost.

Figure 3:
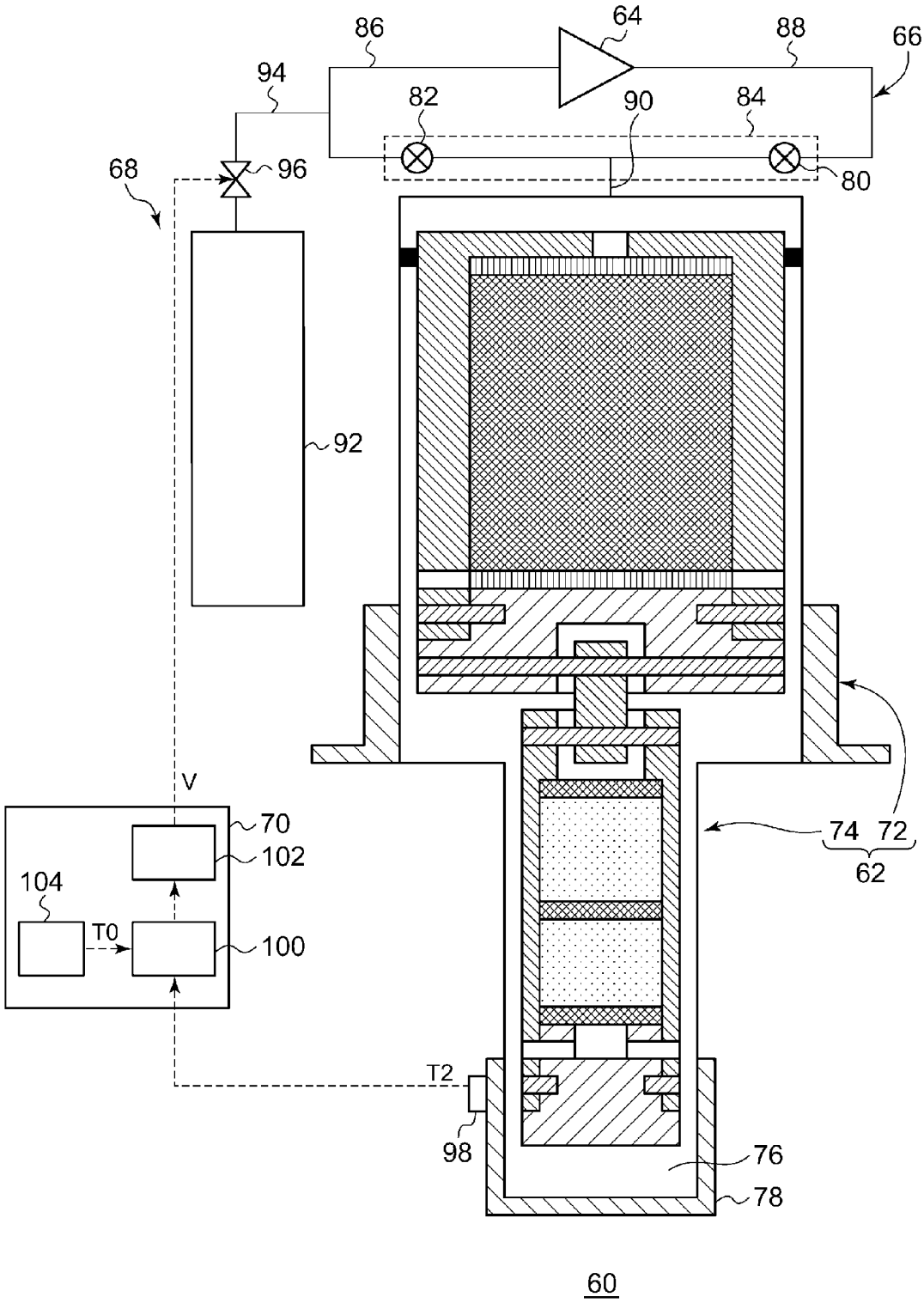
FIG. 3 is a schematic diagram showing a cryocooler according to another embodiment of the present invention.

FIG. 3 is a schematic diagram showing a cryocooler 60 according to another embodiment of the present invention. The cryocooler 60 includes an expander 62, a compressor 64, a helium gas line 66, a helium tank portion 68, and a helium tank control unit 70. The cryocooler 60 is a two-stage type cryocooler. Accordingly, the expander 62 includes a first stage cooling unit 72 and a second stage cooling unit 74. The second stage cooling unit 74 includes a second stage helium expansion chamber 76, and a second stage heat exchanger 78 or a second cooling stage which encloses the second stage helium expansion chamber 76.

A helium gas line 66 connects the expander 62 to the compressor 64 so that low-pressure helium is recovered from the expander 62 to the compressor 64 and high-pressure helium is supplied from the compressor 64 to the expander 62. Hereinafter, the pressure on the low-pressure side of the compressor 64 is referred to as an operation low-pressure of the compressor 64. The helium gas line 66 includes a valve portion 84 which includes a supply valve 80 and a return valve 82. In addition, the helium gas line 66 includes a low-pressure line 86, a high-pressure line 88, and a common supply-return line 90. The low-pressure line 86 connects the return valve 82 to a low-pressure port of the compressor 64. The high-pressure line 88 connects the supply valve 80 to a high-pressure port of the compressor 64. The common air supply-return line 90 connects the valve portion 84 to a room temperature chamber of the first stage cooling unit 72.

The helium tank portion 68 is connected to the cryocooler 60 so as to supply helium to the cryocooler 60. The helium tank portion 68 includes a helium tank 92, a connection line 94 which connects the helium tank 92 to the helium gas line 66 of the cryocooler 60, and a valve 96 which is installed in the connection line 94.

The helium tank 92 is a pressure vessel which is configured so as to accumulate helium gas having a predetermined pressure. The pressure and the volume of the helium tank 92 are designed so that the operation low-pressure of the compressor 64 increases so as to reach a target pressure according to the supply of helium from the helium tank 92 to the helium gas line 66. The target pressure is equal to or higher than a pressure value which is determined by the α curve within the above-described superfluidity temperature range or at approximately the superfluidity temperature. For example, the helium tank 92 is designed so that the operation low-pressure of the compressor 64 increases from an initial operation low-pressure (for example, 8 bar) to 15 bar or higher in the superfluidity temperature range or at approximately the superfluidity temperature.

The valve 96 is configured so as to control a helium gas flow of the connection line 94. The valve 96 is controlled according to a valve control signal V which is input from the helium tank control unit 70. That is, the valve 96 is opened and closed according to the valve control signal V, and an opening degree of the valve 96 is adjusted. The valve 96 is connected so as to be communicable with the helium tank control unit 70 to receive the valve control signal V.

When the valve 96 is opened, the helium tank 92 is connected to the helium gas line 66 through the connection line 94, and the flow of the helium gas between the helium tank 92 and the helium gas line 66 is admitted. When the valve 96 is closed, the helium tank 92 is intercepted from the helium gas line 66, and the flow of the helium gas between the helium tank 92 and the helium gas line 66 is intercepted.

The helium tank portion 68 is connected to the low-pressure side of the compressor 64. The connection line 94 connects the helium tank 92 to the low-pressure line 86. If the pressure of the helium tank is higher than the operation low-pressure of the compressor 64, the helium is supplied from the helium tank 92 to the cryocooler 60 when the valve 96 is opened. If the pressure of the helium tank is lower than the operation low-pressure of the compressor 64, the helium is recovered from the cryocooler 60 to the helium tank 92 when the valve 96 is opened. Accordingly, by connecting the helium tank portion 68 to the low-pressure side of the compressor 64, it is possible to cause the pressure of the helium tank to be relatively low. Accordingly, the structure of the helium tank 92 is simplified and the weight thereof decreases.

In addition, the helium tank portion 68 may be connected to the high-pressure side of the compressor 64. In this case, in order to supply the helium from the helium tank 92 to the cryocooler 60, the pressure of the helium tank is required to be higher than the pressure on the high-pressure side of the compressor 64.

The cryocooler 60 includes a second stage temperature sensor 98 which measures the temperature of the second stage helium expansion chamber 76 and/or a second stage heat exchanger 78. The second stage temperature sensor 98 is attached to the second stage heat exchanger 78 of the expander 62. The second stage temperature sensor 98 is connected so as to be communicable with the helium tank control unit 70 to output the measured temperature T2 to the helium tank control unit 70.

The helium tank control unit 70 is configured so as to control the helium tank portion 68 to start the supply of the helium from the helium tank portion 68 to the cryocooler 60 based on the temperature of the second stage helium expansion chamber 76 and/or the second stage heat exchanger 78.

The helium tank control unit 70 includes a temperature comparison unit 100 and a valve control unit 102. The temperature comparison unit 100 is configured so as to compare the measured temperature T2 and a temperature threshold value T0. The temperature comparison unit 100 is configured so as to output the results of the temperature comparison to the valve control unit 102. The valve control unit 102 is configured so as to generate the valve control signal V according to the input from the temperature comparison unit 100. The valve control unit 102 closes the valve 96 when the measured temperature T2 is higher than the temperature threshold value T0, and opens the valve 96 when the measured temperature T2 is lower than or equal to the temperature threshold value T0. The temperature threshold value T0 is predetermined from a temperature range which is higher than 2.17 K and is lower than or equal to 5 K. For example, the temperature threshold valve T0 may be 4 K. The helium tank control unit 70 may include a storage unit 104 which stores the temperature threshold value T0.

According to this configuration, a cooling temperature of the second stage cooling unit 74 is monitored in a cooling process from room temperature to a cryogenic temperature. In the early stages of the operation of the cryocooler 60, since the measured temperature T2 is higher than the temperature threshold value T0, the valve 96 is closed, and the helium is not supplied from the helium tank 92 to the helium gas line 66. In this case, the pressure of the helium tank 92 is maintained to an initial pressure in design. The cryocooler 60 is operated at an initial operation pressure of the compressor 64. If the cooling process proceeds and the measured temperature T2 decreases down to the temperature threshold value T0, the valve 96 is opened, and the supply of the helium from the helium tank 92 to the low-pressure line 86 of the helium gas line 66 starts. Accordingly, the helium tank portion 68 increases the amount of the helium gas of the cryocooler 60. As a result, the operation low-pressure of the compressor 64 increases so as to be equal to or higher than the pressure value determined from the α curve within the superfluidity temperature range or at approximately the superfluidity temperature.

Accordingly, as described above, the cryocooler 60 can generate a coldness having 2.17 K or lower. In addition, in a temperature region higher than 4 K, the cryocooler 60 can be operated at a low helium pressure suitable for the temperature region.

The cooling temperature may increase immediately after the valve 96 is open. This is a transitional phenomenon which is generated according to an increase in the amount of the helium gas of the cryocooler 60. Accordingly, the helium tank control unit 70 may be configured so as to temporarily ignore the measured temperature T2 immediately after the valve 96 is opened. For example, the valve control unit 102 may be configured so as to continuously open the valve 96 during a predetermined time regardless of the input of the temperature comparison unit 100 if the valve 96 is opened once. Accordingly, it is possible to avoid closing of the valve 96 and stopping of the helium supply due to the transitional increase of the temperature.

Moreover, in order to decrease or prevent the transitional increase of the temperature, the helium tank control unit 70 may be configured so as to control the helium tank portion 68 so that helium is gradationally supplied from the helium tank portion 68 to the cryocooler 60. Accordingly, the valve control unit 102 may repeat the opening and the closing of the valve 96. In this way, the helium is gradually supplied, and it is possible to prevent the temperature from increasing.

The helium tank control unit 70 may be configured so as to control the helium tank portion 68 so that the supply of the helium from the helium tank portion 68 to the cryocooler 60 stops based on the pressure of the operation low-pressure of the compressor 64 and/or the pressure of the helium tank 92.

The operation low-pressure of the compressor 64 may be measured by a compressor pressure sensor which is built into the compressor 64. The pressure of the helium tank 92 may be measured by a tank pressure sensor which is attached to the helium tank 92. The pressure sensor is connected so as to be communicable with the helium tank control unit 70 to output the measured pressure to the helium tank control unit 70.

The helium tank control unit 70 may include a pressure comparison unit which is configured to compare a predetermined pressure threshold value and the measured pressure, and output the compared results to the valve control unit 102. For example, the pressure threshold value is the above-described target pressure. The valve control unit 102 may be configured so as to generate the valve control signal V according to the input from the pressure comparison unit. The valve control unit 102 may close the valve 96 when the measured pressure is equal to or higher than the pressure threshold value, and may continuously open the valve 96 when the measured pressure is lower than the pressure threshold value. The pressure threshold value may be stored in the storage unit 104.

The initial pressure of the helium tank 92 may be an average pressure of the high pressure and the low pressure of the compressor 64. Accordingly, by opening the valve 96 during stopping of the operation of the cryocooler 60, the pressure of the helium tank 92 can be restored to the initial pressure for the next operation. Alternatively, the helium tank 92 may be connected to the high-pressure side of the compressor 64 so as to be restored to the initial pressure.

Figure 4:
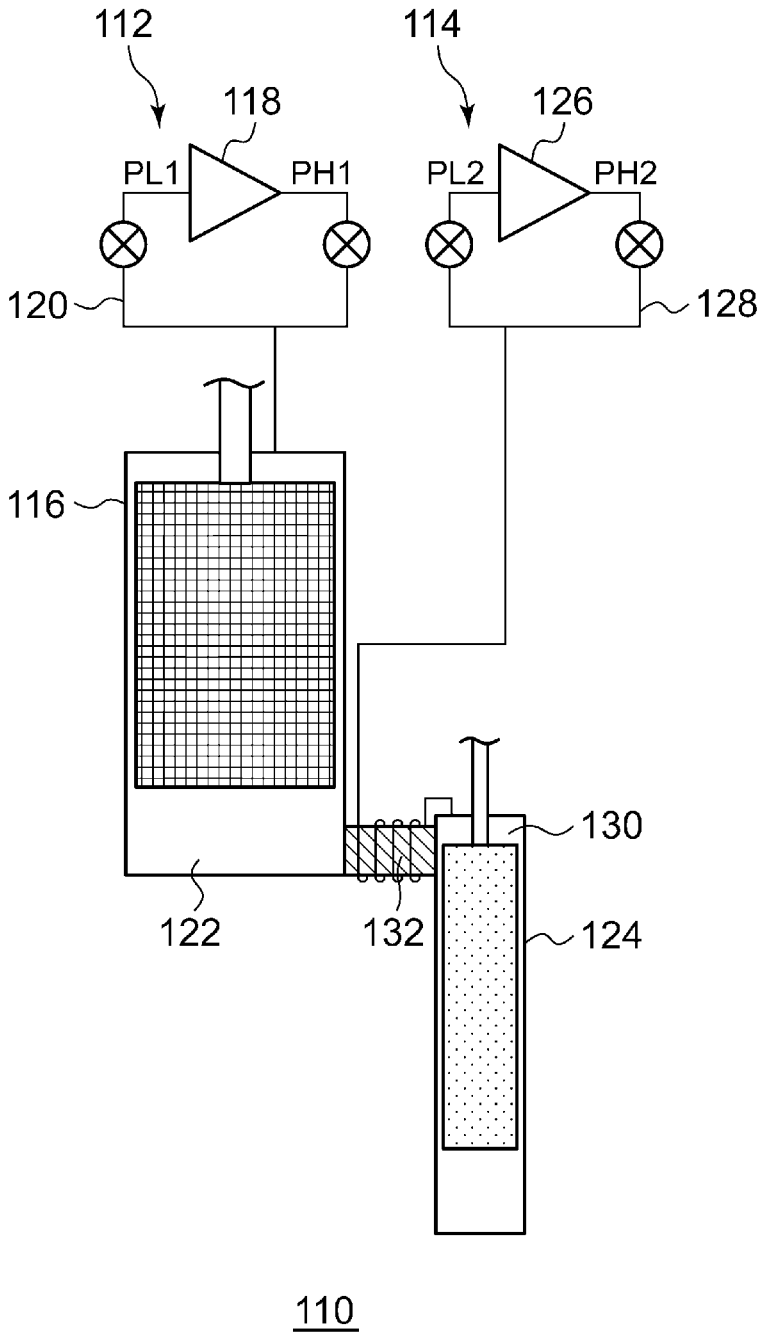
FIG. 4 is a schematic diagram showing a cryocooler according to still another embodiment of the present invention.

FIG. 4 is a schematic diagram showing a cryocooler 110 according to still another embodiment of the present invention. The cryocooler 110 includes a first cooling unit 112 which provides a pre-cooling function, and a second cooling unit 114 which provides a cooling function with respect to the superfluidity temperature range. The second cooling unit 114 is pre-cooled by the first cooling unit 112. In this way, the cryocooler 110 separately includes a high-temperature stage pre-cooling cryocooler, and a low-temperature stage cryocooler.

The first cooling unit 112 includes a first expander 116, a first compressor 118, and a first helium gas line 120. The first expander 116 includes a helium expansion chamber 122 on the low-temperature side of the first expander 116. The first helium gas line 120 connects the first expander 116 to the first compressor 118 so as to recover helium having a first low-pressure PL1 from the first expander 116 and supply helium having first high-pressure PH1 from the first compressor 118. The shown first cooling unit 112 is a single-stage cryocooler. However, the first cooling unit 112 may be a two-stage type cryocooler (for example, 4K-GM cryocooler).

The second cooling unit 114 includes a second expander 124, a second compressor 126, and a second helium gas line 128. The second expander 124 includes a helium receiving chamber 130 on the high-temperature side of the second expander 124. The helium receiving chamber 130 is thermally connected to the helium expansion chamber 122 of the first cooling unit 112 by a heat transfer member 132. A portion of the heat transfer member 132 is mounted on the helium expansion chamber 122 of the first cooling unit 112, and another portion of the heat transfer member 132 is mounted on the helium receiving chamber 130 of the second cooling unit 114. The first cooling unit 112 pre-cools the second cooling unit 114 by conduction cooling from the helium expansion chamber 122 to the helium receiving chamber 130.

The second helium gas line 128 connects the second expander 124 to the first compressor 118 so as to recover helium having a second low-pressure PL2 from the second expander 124 and supply helium having the second high-pressure PH2 from the second compressor 126. The second helium gas line 128 is separated from the first helium gas line 120. Accordingly, a helium circulation circuit of the second cooling unit 114 is separated from a helium circulation circuit of the first cooling unit 112.

The second cooling unit 114 is operated at a helium pressure different from the helium pressure of the first cooling unit 112. The second low-pressure PL2 is higher than the first low-pressure PL1. The second low-pressure PL2 may be 15 bar or higher. The first low-pressure PL1 may be 8 bar or lower. In addition, the second high-pressure PH2 may be higher than the first high-pressure PH1.

Accordingly, it is possible to operate the cryocooler 110 at the helium pressure suitable for each of the first cooling unit 112 and the second cooling unit 114. That is, the first cooling unit 112 can be operated at a low helium pressure suitable for pre-cooling, and the second cooling unit 114 can be operated at a high helium pressure suitable for cooling of 2.17 K or lower.

Hereinbefore, preferred embodiments of the present invention are described. However, the present invention is not limited to the above-described embodiments, and various modifications and replacements may be applied to the above-described embodiments without departing from the scope of the present invention.

In the above, it is described under the presumption that the cryocooler 1 is a GM cryocooler. In addition to this, the cryocooler 1 may be a displacer type Stirling cryocooler having helium-4 as the operation fluid. In this case, the pressure on the low-pressure side of the compressor may be set with reference to the $\alpha$ curve shown in FIG. 2 based on the target temperature of the Stirling cryocooler. In addition, the pressure on the high-pressure side of the compressor may be set so that the pressure of the helium is less than the liquefaction curve. Accordingly, it is possible to decrease the lowest reached temperature of the Stirling cryocooler, and it is possible to prevent the temperature of the helium gas from increasing due to the adiabatic expansion of helium.

In the above, it is described under presumption that the cryocooler 1 is a single-stage GM cryocooler. The cryocooler 1 may be a multi-stage type GM cryocooler having two stages or more. In this case, the pressure on the low-pressure side of the compressor may be set with reference to the $\alpha$ curve shown in FIG. 2 based on the target temperature of the cryocooler. In addition, the pressure on the high-pressure side of the compressor may be set so that the pressure of the helium is less than the liquefaction curve.

What is claimed is:

1. A cryocooler operating method for cooling helium to around or below 4 K in the cryocooler, the cryocooler operating method comprising:

expanding high-pressure helium in an expander;

compressing in a compressor low-pressure helium, returned from the expander through a low-pressure side of the compressor, to generate high-pressure helium;

supplying the high-pressure helium to the expander through a high-pressure side of the compressor;

detecting temperature of helium in the expander;

calculating entropy of the helium at a target temperature; and when the detected temperature of helium in the expander is 2.17 K or lower, setting a cryocooler operation pressure on the low-pressure side of the compressor so as to be equal to or higher than pressure at an intersection point between a curve, in a helium state diagram whose horizontal axis is temperature and vertical axis is pressure, along which helium's volumetric thermal expansion coefficient is 0, and an isentropic curve for the calculated entropy.

2. The cryocooler operating method according to claim 1, wherein the cryocooler operation pressure on the low-pressure side of the compressor is 15 bar or higher.

3. The cryocooler operating method according to claim 1, wherein the cryocooler operation pressure on the low-pressure side of the compressor is 25 bar or higher.

4. The cryocooler operating method according to claim 1, wherein the cryocooler operation pressure on the high-pressure side of the compressor is lower than or equal to a liquefaction curve for helium in the state diagram.

5. The cryocooler operating method according to claim 4, wherein the cryocooler operation pressure on the high-pressure side of the compressor is 35 bar or lower.

6. The cryocooler operating method according to claim 1, wherein the helium is helium-4.

7. The cryocooler operating method according to claim 1, wherein:

the expander includes a helium expansion chamber and a heat exchanger enclosing the helium expansion chamber; and the cryocooler further includes a helium tank component coupled to the cryocooler to supply helium to the cryocooler, and a helium-tank control unit for controlling the helium tank component to start supply of the helium from the helium tank component to the cryocooler based on temperature of the helium expansion chamber and/or of the heat exchanger.

8. The cryocooler operating method according to claim 7, wherein:

the cryocooler further comprises a temperature sensor attached to the expander to measure temperature of the helium expansion chamber and/or of the heat exchanger, and is connected with the helium tank control unit to enable communications outputting measured temperature to the helium tank control unit;

the helium tank component includes a helium tank, a connection line coupling the helium tank to the cryocooler, and a valve installed in the connection line; and the helium tank control unit includes a temperature comparison unit configured to compare measured temperature with a temperature threshold value, and a valve control unit configured to control the valve according to input from the temperature comparison unit such as to close the valve when the measured temperature is higher than the temperature threshold value, and the valve is opened when the measured temperature is lower than or equal to the temperature threshold value, wherein the temperature threshold value is predetermined from a range of from greater than 2.17 K to less than or equal to 5 K.

9. The cryocooler operating method according to claim 7, wherein the helium tank component is connected to a low-pressure side of the compressor.

10. A cryocooler system for cooling helium to around or below 4 K by expanding helium, the cryocooler system comprising:

an expander for expanding high-pressure helium;

a compressor for compressing low-pressure helium, returned from the expander, to generate high-pressure helium, and supplying the high-pressure helium to the expander;

a helium gas line assembly connecting the expander to the compressor, the helium gas line having a low-pressure line on a low-pressure side of the compressor, and a high-pressure line on a high-pressure side of the compressor;

a helium tank section for supplying helium to the cryocooler, the helium tank section including a helium tank, a connection line connecting the helium tank to the helium gas line, and a valve-control-signal controllable valve installed in the connection line, the helium tank section therein determining a cryocooler operation pressure on the low-pressure side of the compressor;

a helium tank control unit including a temperature comparison unit and a valve control unit, and communicably connected with the valve for sending a valve control signal to the valve;

a temperature sensor for measuring the temperature of the expander, the temperature sensor communicably connected with the helium tank control unit to output measured temperature to the helium tank control unit; wherein the temperature comparison unit is configured to compare the measured temperature with a temperature threshold value and to output the results of the temperature comparison as input into the valve control unit;

the valve control unit is configured to generate a valve control signal for adjustably opening and closing the valve according to the input from the temperature comparison unit, the valve control unit via the valve control signal closing the valve when the measured temperature is greater than the temperature threshold value, and opening the valve when the measured temperature is less than or equal to the temperature threshold value; and the helium tank control unit controls the helium tank section to supply helium to the cryocooler such that when helium temperature in the expander is 2.17 K or lower, the cryocooler operation pressure on the low-pressure side of the compressor is equal to or higher than pressure given by a curve, in a helium state diagram whose horizontal axis is temperature and vertical axis is pressure, along which helium's volumetric thermal expansion coefficient is 0.

* * * * *